US006590992B1

(12) United States Patent
Nakamura

(10) Patent No.: US 6,590,992 B1
(45) Date of Patent: Jul. 8, 2003

(54) SPEAKER DEVICE

(75) Inventor: Takeshi Nakamura, Uji (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/266,711

(22) Filed: Mar. 11, 1999

(30) Foreign Application Priority Data

Mar. 24, 1998 (JP) ..... 10-096708
Jun. 15, 1998 (JP) ..... 10-185614

(51) Int. Cl.[7] ..... H04R 25/00
(52) U.S. Cl. ..... 381/430; 381/190
(58) Field of Search ..... 381/98, 114, 173, 381/190, 152, 191, 430; 310/34, 322; 367/155, 157

(56) References Cited

U.S. PATENT DOCUMENTS 4,228,532 A 10/1980 Sims
4,344,503 A 8/1982 Nakamura et al.
5,185,549 A * 2/1993 Sullivan ..... 381/190
5,241,140 A 8/1993 Itoh et al.
5,802,196 A * 9/1998 Nakamura ..... 381/190
5,881,157 A * 3/1999 Lee et al. ..... 381/98
5,923,766 A * 7/1999 Oda ..... 381/98
5,982,907 A * 11/1999 Akamatsu et al. ..... 361/98
6,058,196 A * 5/2000 Heron ..... 381/423
6,078,670 A * 6/2000 Beyer ..... 381/98

FOREIGN PATENT DOCUMENTS

EP 0 782 370 A2 7/1997
EP 0 810 811 12/1997
GB 2 223 377 A 4/1990
GB 2 260 875 A 4/1993

OTHER PUBLICATIONS

M. Colloms, "High Performance Loudspeakers", 5th Edition, 1997, Wiley, pp. 216–219.

* cited by examiner

*Primary Examiner*—Curtis Kuntz
*Assistant Examiner*—Suhan Ni
(74) *Attorney, Agent, or Firm*—Keating & Bennett, LLP

(57) ABSTRACT

A speaker device is capable of accurately generating sound even within a high audio region, without high sound pressure even when generating a large sound. The speaker device includes a sound-producing vibrator having a vibrating body which is, for instance, a semi-spherical piezoelectric ceramic. Electrodes are provided on both surfaces of the vibrating body. An input signal from an amplifier is input between the electrodes so that the vibrating body is vibrated and sound is produced. The resonant frequency of the sound-producing vibrator is set higher than about 20 kHz, which is the upper limit of the human audible range. Furthermore, the thickness of the vibrating body is increased and its mass is increased.

22 Claims, 3 Drawing Sheets

SPEAKER DEVICE

BACKGROUND OF THE INVENTION

1. Field of the Invention

The present invention relates to a speaker device, more particularly, to a speaker device used for generating music, for example.

2. Description of the Related Art

As a first example of a speaker device for generating music, a dynamic speaker includes a vibrator which is made of a cone of paper or the like and is vibrated using a voice coil and a magnet. In addition, a second example of a speaker for generating music is a capacitor speaker which is adapted to generate sound using an electrical charge.

However, the resonant frequency of such conventional dynamic and capacitor speakers is approximately 40 Hz~200 Hz, which is considerably lower than the upper limit of the human audible range, that is, approximately 20 kHz. Therefore, when music and other sounds are generated, sound at frequencies above the resonant frequency are necessarily generated. The motion of a vibrator which defines a speaker driving system is best at the resonant frequency, but there is a disadvantage that when a signal higher than the resonant frequency is input, the motion of the vibrator lags behind the input signal. Consequently, it is not possible to reliably and accurately generate sound in higher frequency regions, such as regions having a frequency that is higher than the resonant frequency. For instance, when humans actually listen to the sound of a drum, first the listener hears the sound of the stick strike the skin of the drum, and afterwards, the listener hears the sound produced by the vibrating skin of the drum. However, when this is generated on a conventional speaker, the fraction of sound when the stick strikes the drum is not generated, and a listener only hears the sound of the drum itself. It is believed that this is because, when a high-frequency signal at the moment when the stick strikes the skin is input, such a sound is not generated due to poor responsiveness of the vibrator, whereas the subsequently input low-frequency sound of the drum is generated.

Furthermore, a vibrator made of paper or similar material has a small mass and is easily influenced by outside pressure, whereby its acoustic characteristics are altered by outside pressure. Furthermore, when considering sound as energy, in a case where sound is generated by vibrating a low-mass vibrator, when a signal of large energy is input, the amplitude of the vibrator will increase, and as a consequence, sound pressure of the generated sound will increase. However, when sound pressure increases, the effect on the human body increases, which is unpleasant for the human listener.

SUMMARY OF THE INVENTION

In order to overcome the problems described above, preferred embodiments of the present invention provide a speaker device which is constructed to accurately generate sound at high audio regions and in which sound pressure does not increase when large sound is generated.

According to one particular preferred embodiment of the present invention, a speaker device includes a sound-producing vibrator having a vibrating body constructed to be vibrated by an input signal for producing sound from vibrations of the vibrating body and a signal input for applying the input signal to the sound-producing vibrator, wherein a resonant frequency of the sound-producing vibrator is higher than a frequency of the input signal.

Preferably, in the speaker device of preferred embodiments of the present invention, the resonant frequency of the sound-producing vibrator does not change substantially when the mass of the vibrating body is changed.

To obtain such a speaker device, the vibrating body can, for instance, be made of piezoelectric ceramic.

Delay in the vibration of the vibrating body relative to input signals having a frequency below the resonant frequency can be significantly reduced by increasing the resonant frequency of the sound-producing vibrator above the frequency of the input signal. Particularly, when the sound-producing vibrator has a resonant frequency higher than the upper limit of the human audible range of approximately 20 kHz, all sounds audible to humans can be accurately generated.

Furthermore, since the resonant frequency of the sound-producing vibrator is constructed so as to not be substantially altered by changes in the mass of the vibrating body, the mass of the sound-producing vibrator can be made large, and consequently, the effects of outside pressure on the sound-producing vibrator can be eliminated. In addition, even when a signal of great energy is input to the sound-producing vibrator, the sound pressure of generated sound can be reduced without increasing the thickness of the vibrating body.

Furthermore, the vibrating body may be made of piezoelectric ceramic, thereby increasing the mass of the sound-producing vibrator.

The above and further objects, characteristics and advantages of the present invention will more fully appear from the following detailed description of preferred embodiments taken in conjunction with the accompanying drawings.

DETAILED DESCRIPTION OF PREFERRED EMBODIMENTS

Figure 1:
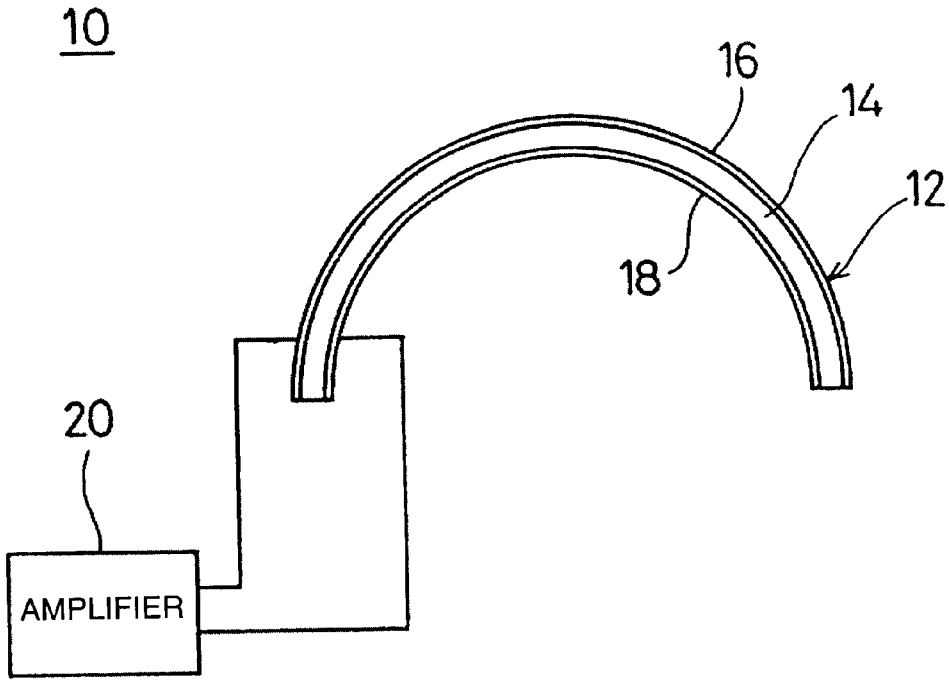
FIG. 1 is a diagrammatic view of a speaker device according to a preferred embodiment of the present invention.
Figure 2:
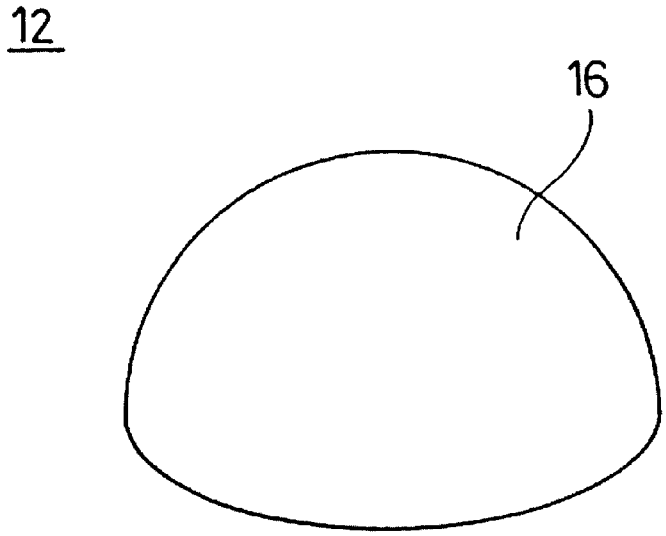
FIG. 2 is a perspective view of an example of a sound-producing vibrator used in the speaker device shown in FIG. 1.
Figure 3:
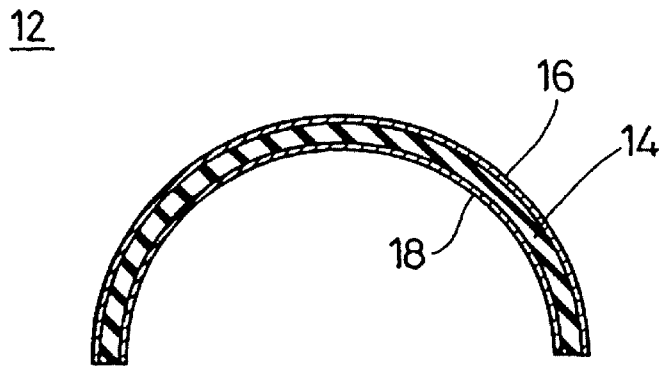
FIG. 3 is a cross-sectional view of the sound-producing vibrator shown in FIG. 2.

FIG. 1 is a diagrammatic view of an example of the speaker device of a preferred embodiment of the present invention. A speaker device 10 preferably includes a sound-producing vibrator 12. As shown in FIG. 2 and FIG. 3, the sound-producing vibrator 12 includes, for instance, a substantially semi-spherical vibrating body 14. The vibrating body 14 is preferably made of, for instance, piezoelectric ceramic. An electrode 16 and an electrode 18 are provided entirely over both surfaces of the vibrating body 14. Then, the vibrating body 14 is polarized in the direction of its thickness. In addition, the speaker device 10 includes a signal input, for instance, an amplifier 20, in order to apply a signal to the vibrator 12. The amplifier 20 applies an input signal between the two electrodes 16 and 18.

In the speaker device 10, when an input signal is input between the electrodes 16 and 18 on both surfaces of the vibrating body 14, the vibrating body 14 vibrates, whereby sound can be produced. The resonant frequency $f_0$ of this type of substantially semi-spherical sound-producing vibrator 12 is determined by the following approximate equation:

$$f_0 \approx \frac{1}{2\pi a}\sqrt{\frac{E}{1-\sigma\rho}} \qquad \text{Equation 1}$$

In the above approximate equation, a represents the radius of the vibrating body 14, E is the Young's Modulus of the vibrating body 14, ρ is the density of the vibrating body 14, and σ is its Poisson's ratio.

For instance, when the substantially semi-spherical vibrating body 14 is made of piezoelectric ceramic, it is possible to obtain a sound-producing vibrator 12 which has a radius of about 4 cm and a resonant frequency of about 25 kHz, which is greater than 20 kHz, which is the upper limit of the human audible range. Because of the excellent responsiveness of the resonating body 14 achieved by using the sound-producing vibrator 12, it is possible to accurately generate all sounds audible to the human ear, even when the input signal is at a frequency below the resonant frequency.

Figure 4:
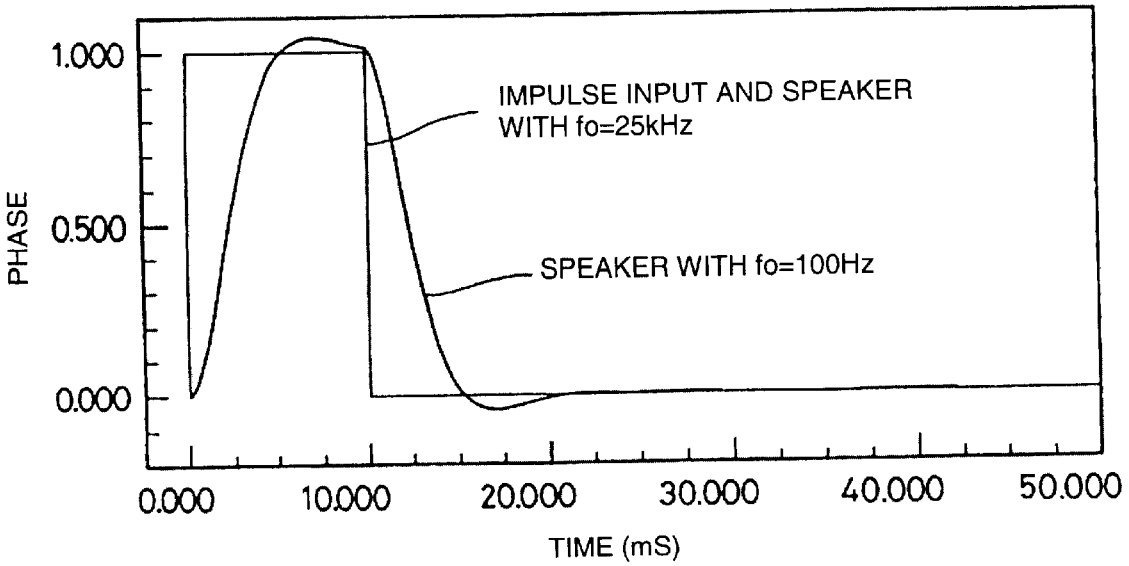
FIG. 4 is a graph illustrating a responsiveness of the speaker device according to a preferred embodiment of the present invention and a conventional speaker device.

FIG. 4 shows results of a simulation carried out to investigate responsiveness of speaker devices, in which the speaker device according to a preferred embodiment of the present invention having an approximate resonant frequency $f_0$=25 kHz, was compared with a conventional dynamic speaker device having a resonant frequency $f_0$=100 Hz. FIG. 4 shows responsiveness of the vibrating body of each speaker device when an impulse of constant Q=0.707 and pulse width of 10 mS was input. The results prove that in the speaker device where $f_0$=100 Hz, the phase of the vibrating body lagged behind the impulse, but in the speaker device where $f_0$=25 kHz, the phase of the vibrating body was almost identical to the input of the impulse. In FIG. 4, only two waveforms are shown, because the waveform of the input impulse and the phase waveform of the speaker device in which $f_0$=25 kHz overlap. From these results, it can be understood that the speaker device according to this example of preferred embodiments of the present invention, in which $f_0$=25 kHz, has far better responsiveness than the conventional speaker device, in which $f_0$=100 Hz.

Furthermore, as shown in the above approximate equation, the resonant frequency f of the sound-producing vibrator 12 is hardly affected by the thickness of the vibrating body 14. Therefore, when the thickness of the vibrating body 14 is increased within a certain range, the mass of the sound-producing vibrator 12 can be increased.

Table 1 shows the relation between thickness and mass of the vibrating body 14 and the resonant frequency of the sound-producing vibrator 12 in the speaker device 10, having a vibrating body 14 including a substantially semi-spherical piezoelectric ceramic, according to a preferred embodiment of the present invention.

TABLE 1

| Thickness t (mm) | Mass m (g) | Resonant frequency $f_0$ (kHz) |
|---|---|---|
| 0.5 | 51.18 | 24.32 |
| 1.0 | 78.19 | 23.95 |
| 2.0 | 138.05 | 24.36 |
| 3.0 | 185.07 | 24.87 |

Since sound can be considered as energy, when the mass of the sound-producing vibrator 12 increases, it is possible to obtain the same audio energy while reducing the width of the vibrating body 14 and reducing sound pressure of the generated sound. Therefore, even when a large sound is generated, the sound pressure is not large, enabling the affect on the human body to be reduced, thereby obtaining a more pleasant sound.

Furthermore, it is possible to control breathing and standing waves in the room caused by sound pressure and vibrations of objects in the room and the like, whereby a more pleasant sound can be obtained. In addition, increasing the mass of the vibrating body 14 reduces the external effect whereby the vibration of the vibrating body 14 is impeded by outside pressure, preventing audio characteristics from deteriorating.

Figure 5:
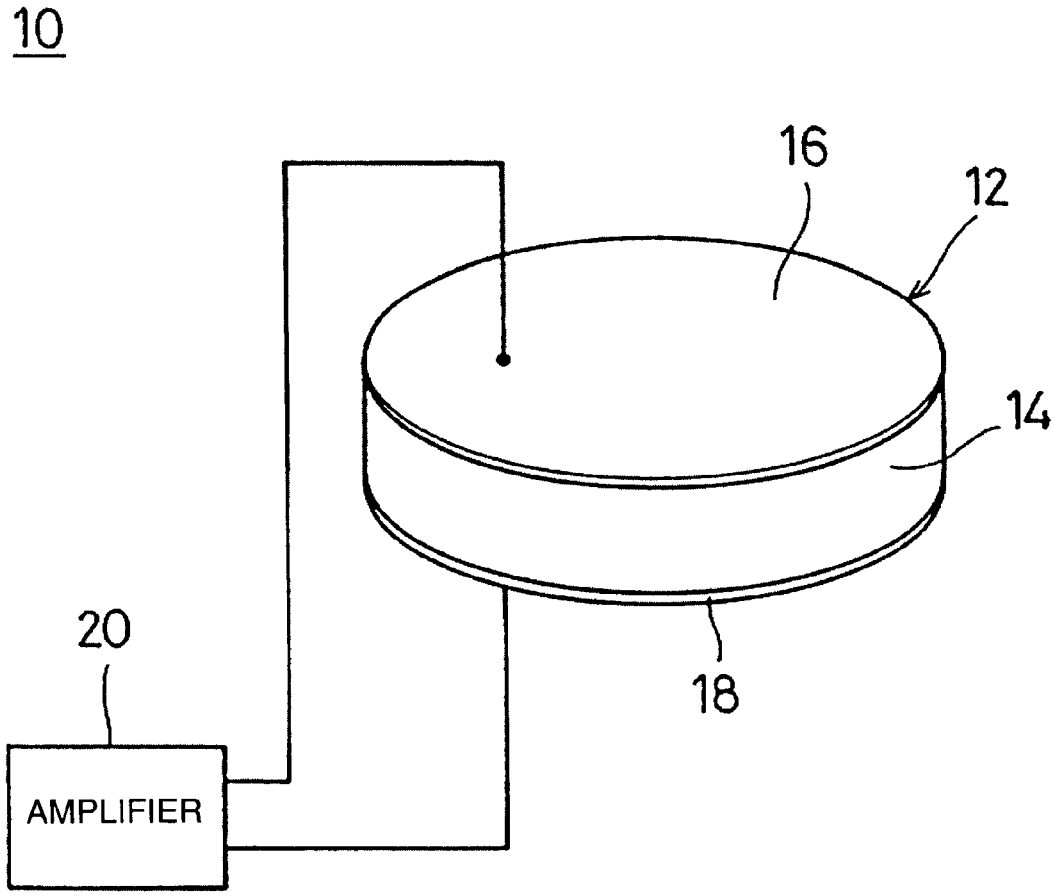
FIG. 5 is a perspective view of a speaker device according to another preferred embodiment of the present invention.

In this way, the resonant frequency of the sound-producing vibrator 12 is not altered by changes in the mass of the vibrating body 14. Also, in the speaker device achieving the effects mentioned above, the vibrating body 14 does not have to be semi-spherical; an approximately spherical or partially spherical shape is acceptable. Furthermore, as shown in FIG. 5, the sound-producing vibrator 12 may include electrodes 16 and 18 provided on both surfaces of a substantially circular plate-like vibrating body 14. In this case, the effects described above can be achieved by increasing the width and mass of the vibrating body 14.

Furthermore, since the vibrating body 14 is preferably made of a material of high density, such as piezoelectric ceramic, the above effects can be achieved more easily, and in addition, since piezoelectric ceramic is a material which is excited merely by the input of an electrical signal, there is no need for other mechanical drive elements to excite the vibrating body 14, thereby further simplifying the constitution of the speaker device.

According to preferred embodiments of the present invention, when the resonant frequency of the sound-producing vibrator is set at a high frequency, the vibration of the vibrating body does not lag behind the input signal, and the sound can be completely and accurately generated within the human audible range. Furthermore, by increasing the mass of the sound-producing vibrator, it is possible to achieve a speaker device which obtains pleasant sound with low sound pressure, and which is hardly affected by outside pressure.

While the invention has been particularly shown and described with reference to preferred embodiments thereof, it will be understood by those skilled in the art that the forgoing and other changes in form and details may be made therein without departing from the spirit of the invention.

What is claimed is:

1. A speaker device comprising:

a sound-producing vibrator having a resonant frequency $f_0=1/2\pi a\sqrt{(E/1-\sigma\rho)}$, where a is the radius of the sound-producing vibrator, E is the Young's Modulus of the sound-producing vibrator, ρ is the density of the sound-producing vibrator, and σ is the Poisson's ratio of the sound-producing vibrator, and including a vibrating body having two surfaces and electrodes provided on both of said two surfaces of said vibrating body, the sound-producing vibrator being constructed to be vibrated by input signals having various frequencies including input signals at the maximum frequency in the human audible range, the input signals being applied directly to the sound-producing vibrator to produce sound from vibration of said vibrating body; wherein the resonant frequency $f_0$ of said sound-producing vibrator is greater than every frequency of the various frequencies of said input signals applied directly to the sound-producing vibrator.

2. A speaker device according to claim 1, wherein the resonant frequency of said sound-producing vibrator is not substantially changed when a mass of said vibrating body is changed.

3. A speaker device according to claim 1, wherein said vibrating body comprises piezoelectric ceramic.

4. A speaker device according to claim 1, wherein said vibrating body has a substantially semi-spherical shape.

5. A speaker device according to claim 1, wherein a resonant frequency of said vibrating body is about 25 kHz.

6. A speaker device according to claim 1, further comprising a first electrode disposed on an outer surface of said vibrating body and a second electrode disposed on an inner surface of said vibrating body.

7. A speaker device according to claim 6, wherein the first electrode covers substantially all of the outer surface of said vibrating body.

8. A speaker device according to claim 6, wherein the second electrode covers substantially all of the inner surface of said vibrating body.

9. A speaker device according to claim 1, wherein said vibrating body is polarized in a thickness direction thereof.

10. A speaker device according to claim 1, wherein said vibrating body is constructed such that vibration of said vibrating body does not lag behind the input signal.

11. The speaker device according to claim 1, wherein the input signals are amplified prior to being applied directly to the sound-producing vibrator.

12. A speaker device comprising:

a sound-producing vibrator having a resonant frequency $f_0=1/2\pi a\sqrt{(E/1-\sigma\rho)}$, where a is the radius of the sound-producing vibrator, E is the Young's Modulus of the sound-producing vibrator, ρ is the density of the sound-producing vibrator, and σ is the Poisson's ratio of the sound-producing vibrator, and including a vibrating body having two surfaces and electrodes provided on both of said two surfaces of said vibrating body, the sound-producing vibrator being constructed to be vibrated by input signals having various frequencies and to produce sound from vibration of said vibrating body, the input signals being applied directly to the sound-producing vibrator; wherein the resonant frequency $f_0$ of said sound-producing vibrator is greater than a maximum frequency in the human audible range.

13. A speaker device according to claim 12, wherein the resonant frequency of said sound-producing vibrator is not substantially changed when a mass of said vibrating body is changed.

14. A speaker device according to claim 12, wherein said vibrating body comprises piezoelectric ceramic.

15. A speaker device according to claim 12, wherein said vibrating body has a substantially semi-spherical shape.

16. A speaker device according to claim 12, wherein a resonant frequency of said vibrating body is about 25 kHz.

17. A speaker device according to claim 12, further comprising a first electrode disposed on an outer surface of said vibrating body and a second electrode disposed on an inner surface of said vibrating body.

18. A speaker device according to claim 17, wherein the first electrode covers substantially all of the outer surface of said vibrating body.

19. A speaker device according to claim 17, wherein the second electrode covers substantially all of the inner surface of said vibrating body.

20. A speaker device according to claim 12, wherein said vibrating body is polarized in a thickness direction thereof.

21. A speaker device according to claim 12, wherein said vibrating body is constructed such that vibration of said vibrating body does not lag behind the input signal.

22. The speaker device according to claim 12, wherein the input signals are amplified prior to being applied directly to the sound-producing vibrator.

* * * * *